US005477205A

United States Patent [19]

Burns

[11] Patent Number: 5,477,205

[45] Date of Patent: Dec. 19, 1995

[54] COMBINATION OUTSIDE LIGHT AND AUDIBLE/VISUAL ALARM

[76] Inventor: Lawrence J. Burns, 11782 Bayfield Ct., Reston, Va. 22094

[21] Appl. No.: 120,519

[22] Filed: Sep. 14, 1993

[51] Int. Cl.[6] ..... G08B 5/00

[52] U.S. Cl. ..... 340/332; 340/326; 340/327; 340/328; 340/329; 340/330; 340/331

[58] Field of Search ..... 340/326, 327, 340/328, 329, 330, 331, 332

[56] References Cited

U.S. PATENT DOCUMENTS

| | | | |
|---|---|---|---|
| 4,276,542 | 6/1981 | Russ | 340/326 |
| 4,290,057 | 9/1981 | Knight | 340/539 |
| 4,547,761 | 10/1985 | Jones | 340/331 |
| 4,566,863 | 2/1986 | Goto et al. | 417/295 |
| 4,684,852 | 8/1987 | Balogh | 340/331 |
| 4,686,505 | 8/1987 | Vanderburg | 340/331 |
| 4,739,187 | 4/1988 | Nelson et al. | 307/115 |
| 4,839,630 | 6/1989 | Miller | 340/574 |
| 4,855,723 | 8/1989 | Fritz et al. | 340/691 |
| 4,952,906 | 8/1990 | Buyak et al. | 340/331 |
| 4,958,149 | 10/1990 | Harvey | 340/715 |
| 4,967,177 | 10/1990 | Nguyen | 340/326 |
| 5,070,327 | 12/1991 | Ellingson | 340/331 |
| 5,087,057 | 2/1992 | Kurkowski | 277/222 |
| 5,132,659 | 7/1992 | Kuo | 340/326 |

*Primary Examiner*—Brent Swarthout
*Assistant Examiner*—Daryl C. Pope
*Attorney, Agent, or Firm*—Jones, Tullar & Cooper

[57] ABSTRACT

An alarm system incorporates a three-position wall switch which replaces a conventional two position switch, connected in circuit with a conventional exterior light fixture. The conventional light bulb in the exterior fixture is replaced by an adapter to which is connected an alarm unit and which receives the exterior light bulb. The three-position switch operates the light bulb at one half normal intensity in its normal mode and in its alarm position illuminates the bulb at its rated intensity and at the same time activates the alarm unit. The alarm may include a strobe light and horn for providing a visual and audible alarm. The alarm unit fits within the exterior light fixture and may include an auxiliary switch to allow it to be enabled or disabled as desired, while allowing the light bulb to provide two levels of brightness.

15 Claims, 2 Drawing Sheets

OUTSIDE LIGHT CIRCUIT

OUTSIDE LIGHT CIRCUIT

ALARM UNIT

COMBINATION OUTSIDE LIGHT AND AUDIBLE/VISUAL ALARM

BACKGROUND OF THE INVENTION

The present invention relates, in general, to an alarm system for the exterior of a house operable by a switch inside the house, and more particularly to an alarm unit that is connectable to an existing outside light fixture and a three-position control switch to replace the existing light switch for selectively operating the light and the alarm.

Light blinking systems used as outside alarms or visitor beacons have been known in the past. However, many of these devices are limited in their range of effectiveness to line of sight visibility so that persons indoors or otherwise hidden from the exterior light could not be alerted to an emergency situation by such devices. Furthermore, the blinking apparatus of such devices has conventionally used a relatively small bulb that could easily go unnoticed during the day.

An example of such earlier devices is U.S. Pat. No. 3,568,032 which required the installation of an additional wire between the switch and the light to produce blinking of an outside light. U.S. Pat. Nos. 4,177,408; 4,414,525; and 4,556,863 also disclose apparatus for making an outside light blink. Although no wiring changes were required for these three devices, complex electronic circuits were required in at least one of them, and all of these were expensive and difficult to install.

It is very desirable to have an outside electrical fixture such as a porch light that can instantly be switched to function as an audible/visual alarm to signal neighbors that there is an emergency situation within the house. In addition, such an alarm can be used to guide rescue crews to the correct house. This is particularly important in retirement communities or semi-rural areas where location of the correct house during an emergency is a common problem. In addition, it is desirable to have such an alarm that would be effective both day and night.

SUMMARY OF THE INVENTION

It is, therefore, an object of the present invention to provide an alarm signaling system which can be used in conjunction with a standard outside light fixture for a home.

It is another object of the invention to provide an alarm system which can be utilized in an existing light fixture but which will permit normal operation of the light when the alarm mode is not required.

It is another object of the invention to provide an alarm system for use with existing light fixtures and which can be installed without modification of existing wiring within the walls of the home.

Briefly, in accordance with the invention, a small strobe light/electric horn alarm unit is provided for connection to an existing outdoor light fixture, as by screwing the alarm unit into the existing bulb socket or connecting it to the bulb socket by way of an outlet adapter. The alarm fixture does not block any light from the bulb so that the fixture can function normally in a non-alarm mode, and power for the alarm unit, which includes a strobe, horn, and electronic components, is obtained from the existing fixture outlet. Preferably, the existing bulb in the fixture is replaced by one of almost double the original wattage so that the bulb can produce the required amount of light for normal use when operating at half power, and will produce additional light to serve as a beacon when operating in the alarm mode.

The alarm unit is controlled by a three-position wall switch which directly replaces the usual two-position control switch for the outdoor light fixture. A rectifier is attached between two of the switch terminals in order to provide the required power to selectively operate the exterior lamp alone, or to activate the alarm unit and the bulb.

In a preferred form of the invention, the control switch operates as follows. With the switch in the off position, all power is disconnected and the light fixture remains off. With the switch in the second, or on position, the rectifier is connected in series with the light bulb in the fixture so it burns in a normal steady mode, but at one half its rated intensity. The strobe light and the horn in the alarm unit do not operate, nor do they draw any current since the alarm unit also includes a rectifier to block the rectified power from the switch. In the third, or alarm position, the rectifier on the switch is removed from the circuit, the light bulb is switched to its full rated intensity, and the alarm unit is activated so that its strobe flashes and its horn sounds. Returning the switch to its off position disables the alarm and the bulb.

The alarm unit may incorporate a local on/off switch so that it can be disabled. In this condition, the strobe and horn do not operate, but when the main control switch is shifted to its alarm position, the bulb in the outdoor fixture will burn at its brightest, or rated, intensity to serve as an alarm or beacon.

The alarm unit of the present invention employs a flashing strobe light instead of the blinking bulb provided by most prior art devices. The brilliant flashes of the strobe can clearly be seen even in daylight hours. Furthermore, after dark the flashes will illuminate nearby objects such as trees, autos, walls, and even snow or fog. Thus, people will be able to see reflections of the strobe flashes even if they are not able to see the strobe directly. The electric horn compliments the visual component of the alarm and its sound can be heard indoors or out, thereby attracting more attention than just the flashes.

Installation of all the components of the present invention is very simple, requiring only the replacement of a conventional two-position wall switch with a three-position switch and requiring connection of the alarm unit in an existing fixture simply by screwing an outlet adapter into the existing bulb socket and plugging the alarm unit into the adaptor.

If the device is to be used simply as a beacon to identify the location of a house, for example to guide visitors, the strobe and sound portion of the alarm unit can be disabled and the light bulb in the outdoor fixture can be operated at full intensity so that it will stand out from nearby lighting fixtures.

BRIEF DESCRIPTION OF THE DRAWINGS

The foregoing, and additional objects, features, and advantages of the present invention will become apparent to those of skill in the art from the following detailed description of a preferred embodiment thereof, taken in conjunction with the accompanying drawings, in which.

DETAILED DESCRIPTION OF THE INVENTION

Figure 2:
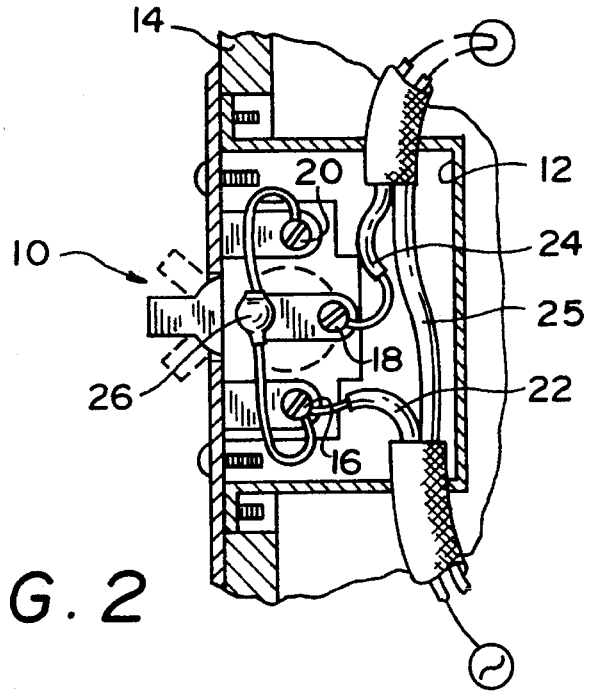
FIG. 2 illustrates, in diagrammatic cross section, an electrical outlet box containing a three-position, single pole double throw switch utilized in conjunction with the components of FIG. 1 to produce the alarm system of the invention.

Turning now to a more detailed consideration of the drawings, wherein common elements are similarly numbered in the various figures, there is illustrated in FIG. 2 a three-position, single pole double throw switch 10 mounted within a conventional electrical switch box 12 secured, for example, to an interior wall 14 of a house. The switch 10, which is illustrated in schematic form in FIG. 3, includes three terminals 16, 18, and 20 connected between an input line 22 and an output line 24. Line 22 and common line 25 are connected to a conventional 120 volt power source, with line 22 being connected to a first switch terminal 16. A diode, or rectifier, 26 is connected between terminal 16 and switch terminal 20, while the output terminal 18, connected to the switch arm 28 of switch 10, is connected to output line 24. Lead 25 is a continuous connection, preferable a ground or neutral wire, as is conventional.

Figure 3:
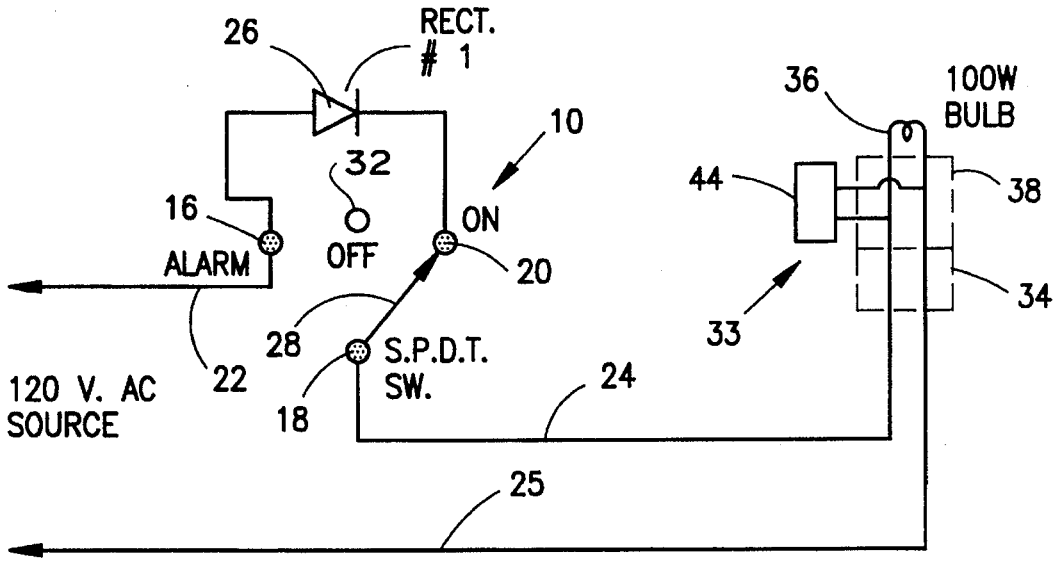
FIG. 3 is a schematic diagram of an electrical lighting circuit modified in accordance with the present invention to incorporate an alarm unit.

As illustrated, the installation of switch 10 does not require any change in electrical line 24, which with ground line 25, may be an existing wire located within the wall of a house and leading to an existing conventional exterior light fixture. As illustrated in FIG. 3, when the switch arm 28 of switch 10 is in a central position between contacts 16 and 20; that is, engaging a contact point 32 in the circuit of FIG. 3, there is no connection between input lead 22 and output lead 24. When switch arm 28 is connected to contact 16, lead 22 is directly connected to lead 24 and diode 26 is bypassed. Finally, when switch arm 28 connects with contact 20, lead 22 is connected to lead 24 through diode 26.

Figure 1:
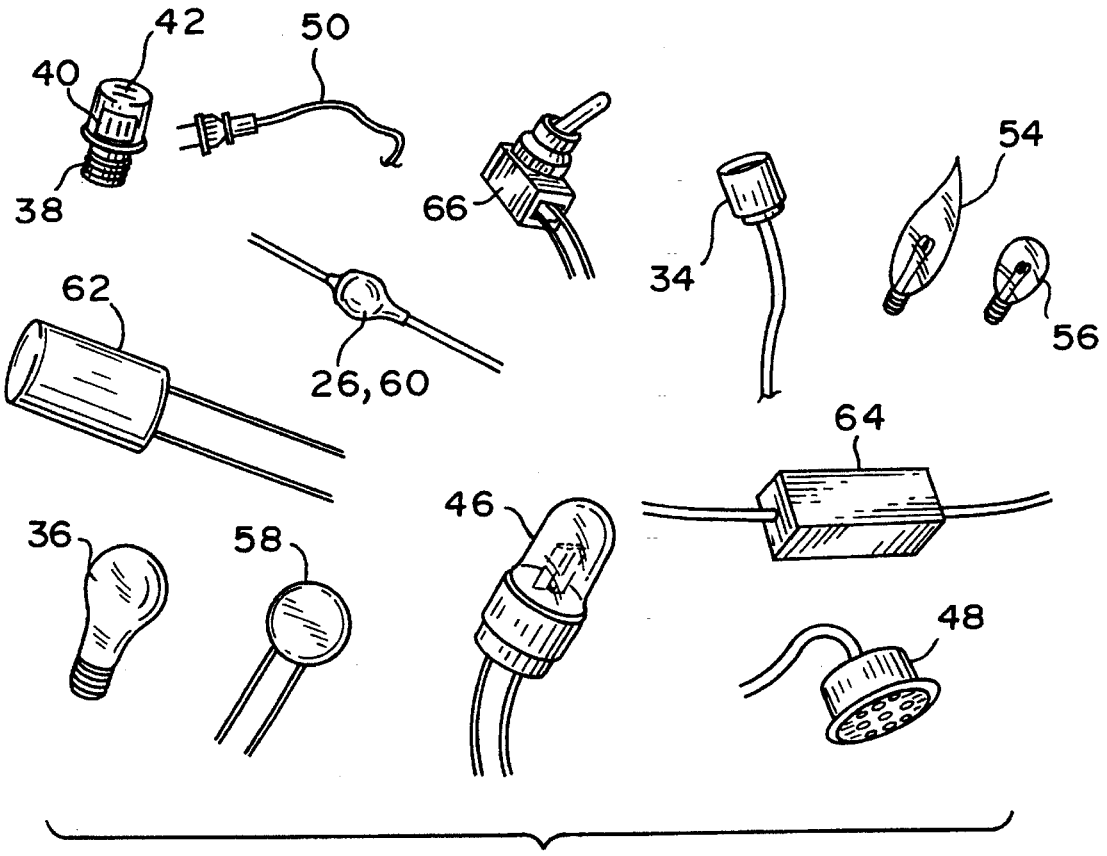
FIG. 1 illustrates in graphical form the electrical and mechanical components required for assembling the alarm of the present invention.

As illustrated in FIG. 3, line 24 is connected at its far end to a conventional outdoor light fixture 33 having a lamp socket 34 of conventional design. The socket 34 normally receives a light bulb 36 which is then normally controlled by a two-way switch in electrical box 12. In accordance with the invention, a conventional socket adapter 38 may be substituted for the light bulb, the socket adapter including, in the preferred form of the invention, an outlet 40 and a bulb socket 42 (see FIG. 1). The adapter is threaded into the socket 34 and the bulb 36 is threaded into socket 42 of the adapter.

Figure 4:
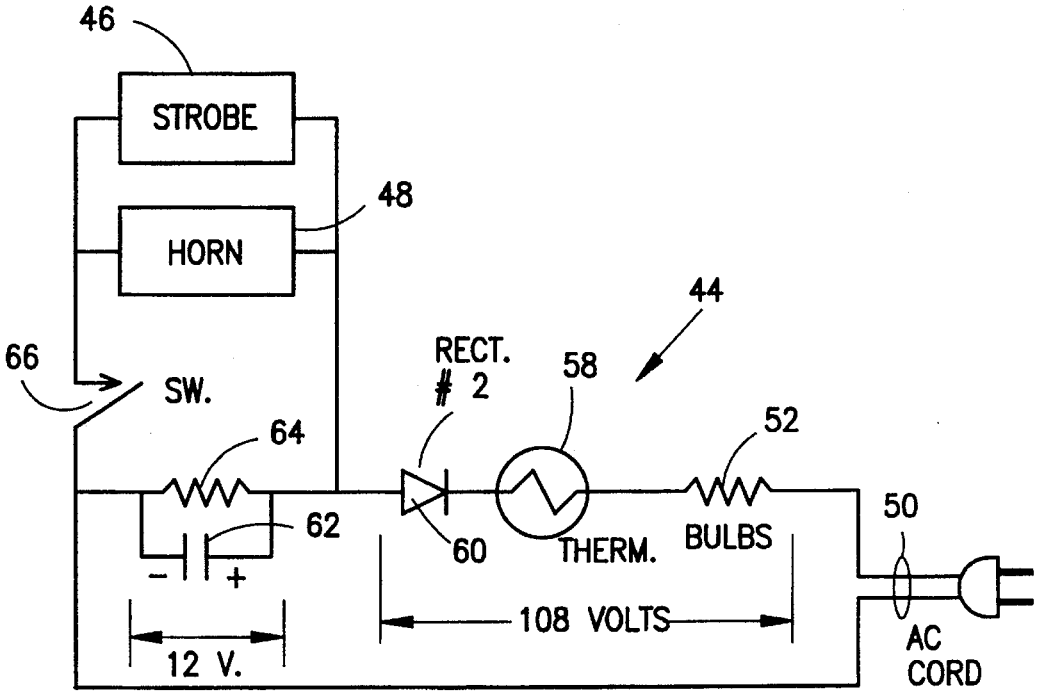
FIG. 4 is a schematic diagram of the strobe/horn alarm unit used in the system of FIG. 3.

An alarm unit 44, such as that illustrated in FIG. 4, is then connected to line 24, by plugging it into the outlet 40 on adapter 38. In this way, both the bulb 36 and the alarm unit 44 are connected to line 24 and thus are controllable by the three position switch 10. The alarm unit 44 incorporates a strobe light 46 and an audible horn 48, and is small enough to fit inside the light fixture 33, preferably below the bulb 36. The alarm unit is a self-contained device which includes an AC power cord 50 with a suitable polarized plug adapted to engage the polarized outlet 40. The unit operates on 120 volt alternating current, so that if it is plugged directly into an AC outlet, it will be activated. However, the alarm unit includes a rectifier 60 so that it does not operate on rectified alternating current, and thus does not operate when it is plugged into adapter 38 and switch 10 is in the normal "on" position with arm 28 connected to contact 20. This is due to the fact that in that position, diode 26 is in series with the line 24, and rectified alternating current is supplied to adapter 38.

The alarm unit includes two major components, the strobe 46 and the horn 48. Both of these devices operate on 12 volts DC. Therefore, the power cord 50 is connected to the horn and the strobe through a series resistance 52, which may be in the form of two 40 watt light bulbs, such as bulb 54 (FIG. 1) and a 6 watt bulb 56, all connected in parallel in line 50. A heavy duty resistor can replace the light bulbs, if desired, although the bulbs are desirable since they provide additional light in the alarm mode. The resistance 52 is connected in series with a nonlinear thermistor 58, which functions as a voltage dropping resistance when the bulb filaments are cold and have little resistance, thereby protecting the unit from a high voltage surge at start up. The thermistor is, in turn, connected in series with the rectifier 60. This rectifier and resistors 52 and 58 drop the voltage in the input line from 120 volts to 12 volts and, when the input to the cord 50 is an alternating current, rectify that to a direct current. The 12 volt rectified direct current is then applied across strobe 46 and horn 48 to activate them. The pulsating 12 volt DC is smoothed by a filter consisting of a capacitor 62 and a resistor 54 connected across the horn and the strobe. A switch 66 is connected between the strobe and horn and the input line 50 to disable the alarm unit when desired.

In operation, the alarm unit 44 is powered by connecting its polarized cord 50 to the polarized outlet 40 of adapter 38 in the light fixture 33. The conventional two position switch operating the normal light fixture is then replaced by the three-position switch 10 with its diode 26, and the device is ready to operate. With the switch arm 28 connected to terminal 20, diode 26 rectifies the input power and pulsating DC is sent to bulb 36 and to the alarm unit 44. The bulb 36 lights at a reduced intensity, but because of the rectifier 60 in the alarm unit, the alarm will not operate. In this steady "on" mode, the alarm unit 44 draws no current.

With switch 10 in the "alarm" position, with switch arm 28 connected to contact 16, diode 26 is removed from the lighting circuit, and 120 volts AC is sent to the light fixture 33. The bulb 36 then lights at its full rated intensity and the 120 volt AC power applied to the alarm unit by way of cord 50 activates the alarm unit. This voltage is reduced to 12 volts DC to cause strobe 46 to light and alarm 48 to sound.

If desired, the alarm unit 44 can be disabled by opening switch 66. In this case, switching the three-position main switch 10 to contact 16 will cause bulb 36 to operate at full intensity without activating alarm 44. This enables the bulb to act as a silent but very bright beacon for visitors, without alarming or annoying neighbors. If desired, individual switches could be used for the strobe 46 and the horn 48.

In summary, with the wall switch 10 in one position, the exterior bulb 36 burns at reduced intensity and the alarm unit is not operational. With switch 10 in its alarm position, the bulb 36 is switched to burn at its full intensity, and the strobe 46 and horn 48 operate. In addition, the bulbs 54 and 56, making up resistance 52, also light, with the thermistor 58 preventing an unwanted current surge when the bulbs are switched on. If the alarm unit switch 66 is turned off, the strobe and horn will not operate, but the light 36 will still shift to its full intensity. With switch arm 28 connected to contact 32, the fixture is turned off.

Because the bulb 36 operates in its normal mode at one half its rated intensity, the bulb life will be extended, providing an additional benefit to the device of the present invention.

Although the invention has been described in terms of a preferred embodiment, it will be apparent that variations and modifications may be made without departing from the true spirit and scope thereof, as set forth in the following claims.

What is claimed is:

1. An alarm apparatus for a conventional switch-operated lighting fixture, comprising:

a lighting fixture having a first lamp socket;

a switchbox for controlling a first lamp in said lighting fixture first lamp socket;

a three-position switch in said switchbox, said switch including a switch arm having first, second and third positions;

wherein said three position switch includes a switch arm terminal and first, second and third terminals;

an input power cable having a lead connected to said three position switch at said third terminal;

an output cable having a lead connected between said switch arm terminal and said first lamp socket, said switch arm selectively connecting said input power cable lead to said output cable lead;

an alarm unit mounted in said lighting fixture and connected to said output cable;

wherein said first, second, and third switch positions comprise "on", "off", and "alarm" positions, respectively, said three position switch further including first diode means connected between said input power cable lead and said output cable lead when said three position switch is in said first, "on" position, whereby a lamp secured in said first lamp socket will operate at a first intensity level;

wherein said alarm unit includes second diode means to prevent said alarm from operating when said switch is in said "on" position; and wherein said input power cable lead is connected directly to said output cable lead, by-passing said first diode means, when said three position switch is in said third, "alarm" position, whereby said lamp will operate at a second intensity level, which is greater than said first intensity level, and said alarm unit will be energized.

2. The alarm apparatus of claim 1, wherein said alarm unit includes at least one alarm device connected in series with said second diode means, whereby said alarm device is energized only when said switch is in said "alarm" position.

3. The alarm apparatus of claim 1, wherein said alarm unit includes a strobe light and an audible alarm connected in series with said second diode means, whereby said strobe light and said audible alarm are energized only when said switch arm is connected to said third terminal.

4. The alarm apparatus of claim 1, further including adapter means for connecting said alarm unit through said lighting fixture first lamp socket to said output cable.

5. The alarm apparatus of claim 4, wherein said adapter means includes an outlet and a second lamp socket, said adapter being threaded into said first lamp socket and receiving said first lamp in said second lamp socket, said alarm unit being connected to said output cable through said adapter outlet.

6. The alarm apparatus of claim 5, wherein said alarm unit further includes resistor means and filter means connected to said second diode means to reduce, rectify and smooth input AC power and to provide low-voltage DC power for said alarm unit.

7. The alarm apparatus of claim 6, further including a second switch means, connected between said alarm unit and said output cable, for selectively disconnecting said alarm unit.

8. The alarm apparatus of claim 7, wherein said input power cable and said output cable are preexisting supply cable for said lighting fixture.

9. Alarm apparatus for a conventional switch-operated lighting fixture, comprising:

a lighting fixture having a first lamp socket;

a switchbox for controlling a lamp in said lighting fixture first lamp socket;

a three-position switch in said switchbox, said switch including a switch arm having first, second and third positions;

wherein said three position switch includes a switch arm terminal and first, second and third terminals;

an input power cable having a lead connected to said three position switch at said third terminal;

an output cable having a lead connected between said switch arm terminal and said first lamp socket, said switch arm selectively connecting said input power cable lead to said output cable lead;

an alarm unit mounted in said lighting fixture and connected to said output cable;

wherein said first, second, and third switch positions comprise "on", "off", and "alarm" positions, respectively, said three position switch further including first diode means connected between said input power cable lead and said output cable lead when said three position switch is in said first, "on" position, whereby a lamp secured in said first lamp socket will operate at a first intensity level;

wherein said alarm unit includes second diode means to prevent said alarm from operating when said switch is in said "on" position; and wherein said input power cable lead is connected directly to said output cable lead, by-passing said first diode means, when said three position switch is in said third, "alarm" position, whereby said lamp will operate at a second intensity level, which is greater than said first intensity level, and said alarm unit will be energized;

wherein said alarm unit includes a strobe light and an audible alarm connected in series with said second diode means, whereby strobe light and audible alarm are energized only when said switch is in said "alarm" position;

adapter means for connecting said alarm unit through said lighting fixture first lamp socket to said output cable; and wherein said adapter means includes an outlet and a second lamp socket, said adapter being threaded into said first lamp socket and receiving a lamp in said second lamp socket, said alarm unit being connected to said output cable through said adapter outlet.

10. The alarm apparatus of claim 9, wherein said alarm unit further includes resistor means and filter means connected to said second diode means to reduce, rectify and smooth input AC power and to provide low-voltage DC power for said alarm unit.

11. The alarm apparatus of claim 10, further including a second switch means, connected between said alarm unit and said output cable, for selectively disconnecting said alarm unit.

12. The alarm apparatus of claim 11, wherein said input power cable and said output cable are preexisting supply cable for said lighting fixture.

13. Alarm apparatus for a conventional switch-operated lighting fixture, comprising:

a lighting fixture having a first lamp socket;

a switchbox for controlling a lamp in said lighting fixture first lamp socket;

a three-position switch in said switchbox, said switch including a switch arm having first, second and third positions;

wherein said three position switch includes a switch arm terminal and first, second and third terminals;

an input power cable having a lead connected to said three position switch at said third terminal;

an output cable having a lead connected between said switch arm terminal and said first lamp socket, said switch arm selectively connecting said input power cable lead to said output cable lead;

an alarm unit mounted in said lighting fixture and connected to said output cable;

wherein said first, second, and third switch positions comprise "on", "off", and "alarm" positions, respectively, said three position switch further including first diode means connected between said input power cable lead and said output cable lead when said three position switch is in said first, "on" position, whereby a lamp secured in said first lamp socket will operate at a first intensity level;

wherein said alarm unit includes second diode means to prevent said alarm from operating when said switch is in said "on" position; and wherein said input power cable lead is connected directly to said output cable lead, by-passing said first diode means, when said three position switch is in said third, "alarm" position, whereby said lamp will operate at a second intensity level, which is greater than said first intensity level, and said alarm unit will be energized;

wherein said alarm unit includes at least one alarm device connected in series with said second diode means, whereby said alarm device is energized only when said switch is in said "alarm" position;

wherein said alarm unit includes a strobe light and an audible alarm connected in series with said second diode means, whereby strobe light and audible alarm are energized only when said switch is in said "alarm" position;

adapter means for connecting said alarm unit through said lighting fixture first lamp socket to said output cable;

wherein said adapter means includes an outlet and a second lamp socket, said adapter being threaded into said first lamp socket and receiving a lamp in said second lamp socket, said alarm unit being connected to said output cable through said adapter outlet; and wherein said input power cable and said output cable are preexisting supply cable for said lighting fixture.

14. The alarm apparatus of claim 13, wherein said alarm unit further includes resistor means and filter means connected to said second diode means to reduce, rectify and smooth input AC power and to provide low-voltage DC power for said alarm unit.

15. The alarm apparatus of claim 14, further including a second switch means, connected between said alarm unit and said output cable, for selectively disconnecting said alarm unit.

* * * * *